US009715196B2

(12) United States Patent
Ishizuka et al.

(10) Patent No.: US 9,715,196 B2
(45) Date of Patent: Jul. 25, 2017

(54) METHOD OF CONTROLLING IMAGE FORMING APPARATUS, IMAGE FORMING APPARATUS AND IMAGE FORMING SYSTEM TO IDENTIFY PAPER POSITION AND PAPER DEFORMATION

(71) Applicant: Konica Minolta, Inc., Chiyoda-ku, Tokyo (JP)

(72) Inventors: Kazuteru Ishizuka, Saitama (JP); Tetsuya Ishikawa, Sagamihara (JP); Hiroshi Morimoto, Akiruno (JP); Kei Okamura, Yokohama (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/698,070

(22) Filed: Apr. 28, 2015

(65) Prior Publication Data

US 2015/0316878 A1 Nov. 5, 2015

(30) Foreign Application Priority Data

May 2, 2014 (JP) ..... 2014-095118

(51) Int. Cl.
*G03G 15/20* (2006.01)
*G03G 15/00* (2006.01)

(52) U.S. Cl.
CPC ..... *G03G 15/20* (2013.01); *G03G 15/2028* (2013.01); *G03G 15/5062* (2013.01); *G03G 15/652* (2013.01); *G03G 15/6594* (2013.01)

(58) Field of Classification Search
CPC ..... G03G 15/6517; G03G 2215/00455; G03G 15/657; G03G 15/6573; G03G 15/6579
(Continued)

(56) References Cited

U.S. PATENT DOCUMENTS 8,075,211 B2 12/2011 Yamamoto
2008/0187384 A1 8/2008 Yamamoto
(Continued)

FOREIGN PATENT DOCUMENTS

JP 2004268572 A 9/2004
JP 2008191215 A 8/2008
(Continued)

OTHER PUBLICATIONS

Japanese Rejection Notice corresponding to Application No. 2014-095118; Dispatch Date: Jul. 19, 2016, with English translation.

*Primary Examiner* — Benjamin Schmitt
*Assistant Examiner* — Milton Gonzalez
(74) *Attorney, Agent, or Firm* — Cantor Colburn LLP

(57) ABSTRACT

A method of controlling an image forming apparatus, an image forming apparatus and image forming system are described, with which banner paper can be processed by appropriately detecting the banner paper in the fixing position when the conveyance of the banner paper is halted. The image forming apparatus comprises a paper conveying unit for conveying banner paper, an image forming unit for transferring an image to the banner paper, a fixing unit for fixing the image to the banner paper in a fixing nip by heating and pressing the banner paper conveyed along a conveying route, and a control unit. This control unit identifies information about the paper position which coincides with the fixing nip when the conveyance of the banner paper is halted and information about the amount of paper deformation of the banner paper in the paper position, and outputs the information which is identified.

24 Claims, 6 Drawing Sheets

(58) Field of Classification Search
USPC ..... 399/384, 388, 389, 397
See application file for complete search history.

(56) References Cited

U.S. PATENT DOCUMENTS

| | | | |
|---|---|---|---|
| 2012/0020689 | A1 | 1/2012 | Inoue et al. |
| 2012/0230719 | A1* | 9/2012 | Matsumoto |

FOREIGN PATENT DOCUMENTS

| | | | |
|---|---|---|---|
| JP | 2012048207 | A | 3/2012 |
| JP | 2013195753 | A | 9/2013 |

* cited by examiner

Fig. 4

| PAPER TYPE | FIXING PRESSURE CONDITION | FIXING TEMPERATURE CONDITION | HALTING TIME | DEFORMATION AMOUNT |
|---|---|---|---|---|
| standard paper | high | 140～160℃ | 0～60 sec | none |
| | | 140～160℃ | longer than 60 sec | none |
| | | 160～170℃ | 0～10 sec | none |
| | | 160～170℃ | longer than 10 sec | small |
| | | 170～180℃ | longer than 0 sec | small |
| | low | 140～160℃ | 0～60 sec | none |
| | | 140～160℃ | longer than 60 sec | none |
| | | 160～170℃ | 0～10 sec | none |
| | | 160～170℃ | longer than 10 sec | none |
| | | 170～180℃ | longer than 0 sec | small |

small: 1.0 mm medium: 1.0～3.0 mm large: 3.0 mm or more

Fig. 5

| PAPER TYPE | FIXING PRESSURE CONDITION | FIXING TEMPERATURE CONDITION | HALTING TIME | DEFORMATION AMOUNT |
|---|---|---|---|---|
| polypropylene paper | high | 140～160℃ | 0～60 sec | small |
| | | 140～160℃ | longer than 60 sec | medium |
| | | 160～170℃ | 0～10 sec | medium |
| | | 160～170℃ | longer than 10 sec | large |
| | | 170～180℃ | longer than 0 sec | large |
| | low | 140～160℃ | 0～60 sec | small |
| | | 140～160℃ | longer than 60 sec | small |
| | | 160～170℃ | 0～10 sec | small |
| | | 160～170℃ | longer than 10 sec | medium |
| | | 170～180℃ | longer than 0 sec | medium |

small: 1.0 mm medium: 1.0～3.0 mm large: 3.0 mm or more

METHOD OF CONTROLLING IMAGE FORMING APPARATUS, IMAGE FORMING APPARATUS AND IMAGE FORMING SYSTEM TO IDENTIFY PAPER POSITION AND PAPER DEFORMATION

CROSS-REFERENCE TO RELATED APPLICATIONS

The present application claims priority under 35 U.S.C. §119 to Japanese Patent Application No. 2014-095118, filed May 2, 2014. The contents of this application are herein incorporated by reference in their entirety.

FIELD OF THE INVENTION

The present invention relates to a method of controlling an image forming apparatus, an image forming apparatus and image forming system.

DESCRIPTION OF THE RELATED ART

Conventionally, an image forming apparatus, and an image forming systems including this image forming apparatus are known. The image forming apparatus forms an image by performing a series of processes which includes transferring an image to a sheet, and then fixing the image to the sheet. The image forming apparatus is provided with a fixing unit for performing a fixing process. The fixing unit is provided with a pair of fixing members forming a fixing nip therebetween and fixes an image onto a sheet by heating and pressing the sheet with the fixing nip. This type of the image forming apparatus can handle not only sheets having predetermined sizes but also long sheets (banner paper) such as continuous paper, for example, extracted from a paper roll.

For example, Japanese Patent Published Application No. 2013-195753 discloses an image forming system provided with an image forming apparatus and an image inspecting apparatus. In this case, the image forming apparatus includes a paper feed apparatus for supplying continuous paper, a printing apparatus, a stack unit for winding and stacking the continuous paper after printing, and a control device. On the other hand, the image inspecting apparatus is provided with an image inspecting apparatus body, a detection sensor and an imaging camera. This image forming system forms a mark on a sheet by the printing apparatus, and the mark is detected by the image inspecting apparatus.

Also, for example, Japanese Patent Published Application No. 2004-268572 discloses a tandem printing apparatus in which a first printer and a second printer are connected in series. The first printer prints a mark on each sheet for page alignment, and the second printer is provided with a mark reading sensor which reads the mark printed by the first printer.

Incidentally, an image forming apparatus sometimes halts conveyance of a sheet with a timing when needed, for example, for the purpose of image stabilization. In the case where a banner paper is used, when paper conveyance is halted, the banner paper is held at the fixing unit and remains there. In this case, the banner paper may be deformed in a position corresponding to the fixing nip due to the heat and pressure applied by the fixing unit. When the banner paper is processed in a finisher with the deformation, the finisher may be damaged by the deformation.

The fixing unit is provided with a mechanism to release pressure engagement by the fixing nip. However, even if this mechanism releases the engagement of fixing members, it cannot sufficiently inhibit the paper from being deformed. A dedicated particular mechanism is thereby needed to sufficiently release the engagement not to cause deformation, so that there is concern over decrease in throughput and cost increase.

Taking into consideration the above circumstances, it is an object of the present invention therefore to provide a method of controlling an image forming apparatus, an image forming apparatus and image forming system, with which banner paper can be processed by appropriately detecting the banner paper which remains in the fixing position when the conveyance of the banner paper is halted.

SUMMARY OF THE INVENTION

To achieve at least one of the abovementioned objects, reflecting one aspect of the present invention, a method of controlling an image forming apparatus is provided with a pair of fixing members between which is formed a fixing nip where paper is heated and pressed to fix an image thereon. This controlling method comprises: a first step of determining whether to halt conveying banner paper; a second step of identifying information about the paper position on the banner paper that coincides with the position of the fixing nip when the conveyance of the banner paper is halted and information about the amount of paper deformation of the banner paper in the paper position; and a third step of outputting the information identified in the second step.

In accordance with the present invention as described above, it is preferred that the third step is a step of outputting data of the identified information.

Also, in accordance with the present invention as described above, it is preferred that the third step is a step of forming the identified information as an image on the banner paper.

Furthermore, in accordance with the present invention as described above, it is preferred that the image formed on the banner paper is character information corresponding to the identified information or a encoded representation from which the identified information can be read out.

Still further, in accordance with the present invention as described above, it is preferred that the amount of paper deformation is identified based on a paper type, a fixing temperature condition, a fixing pressure condition and a halting time.

Still further, in accordance with the present invention as described above, it is preferred that the image forming apparatus is provided with a post-printing unit which performs a post-printing process to the banner paper on which an image is fixed.

In this case, it is preferred that the method further comprises a fourth step of performing a retreat motion of retreating the post-printing unit from a normal position based on the identified information output in the third step. Also, in this case, it is preferred that the retreat motion is performed only when the amount of paper deformation is larger than a predetermined value.

BRIEF DESCRIPTION OF THE DRAWINGS

FIG. 4 is a table showing examples of the amounts of paper deformation occurring in standard sheets.

FIG. 5 is a table showing examples of the amounts of deformation occurring in polypropylene sheets.

DETAILED DESCRIPTION OF THE PREFERRED EMBODIMENTS

First Embodiment

Figure 1:
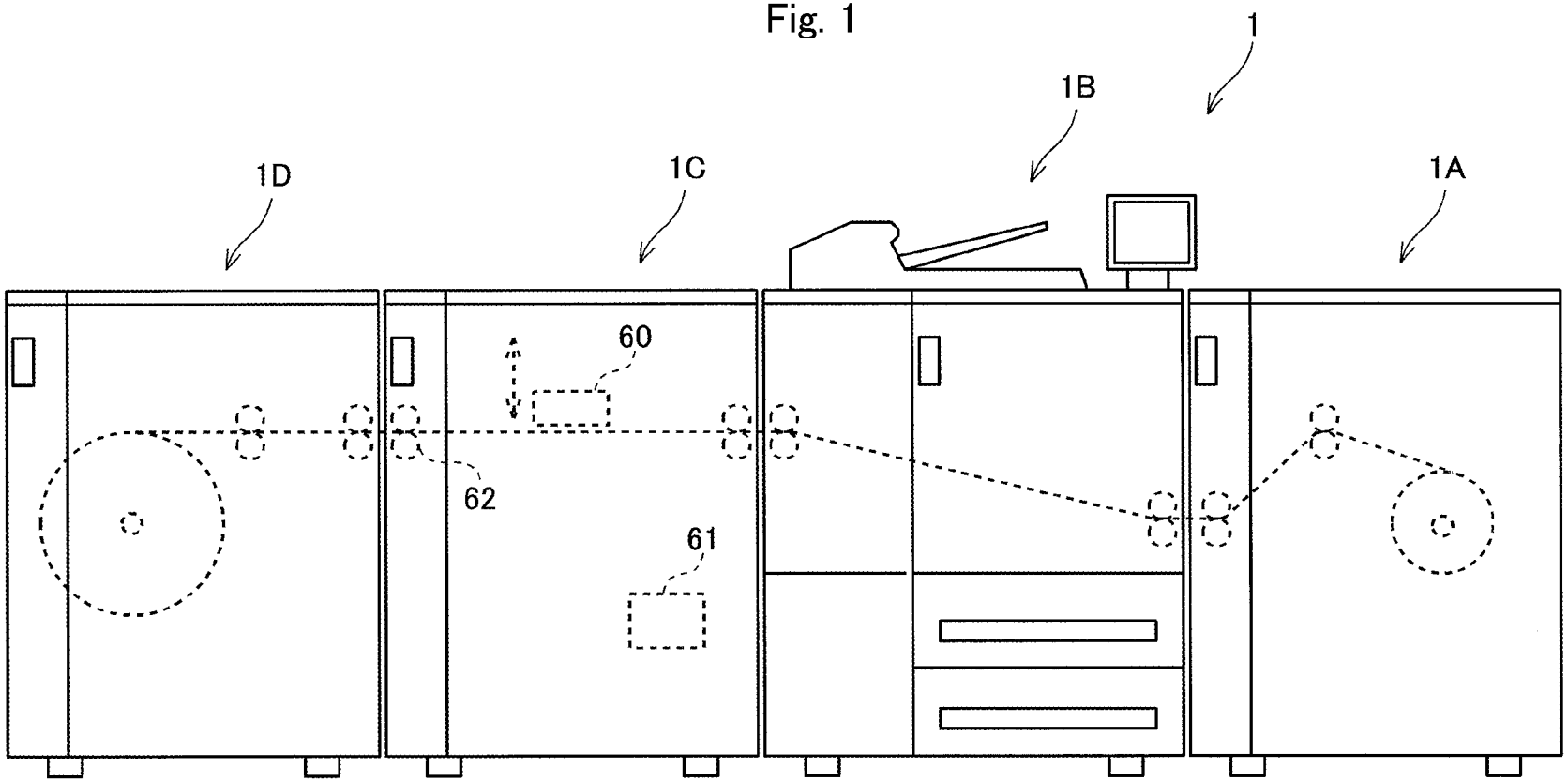
FIG. 1 is an explanatory view for schematically showing the configuration of an image forming system in accordance with a first embodiment.

FIG. 1 is an explanatory view for schematically showing the configuration of an image forming system 1 in accordance with a first embodiment. The image forming system 1 includes a paper feed apparatus 1A, an image forming apparatus body 1B which is an image forming apparatus, a finisher 1C and a winding apparatus 1D.

The paper feed apparatus 1A is used to store long sheets (hereinafter referred to as banner paper) such as continuous paper, for example, extracted from a paper roll, and feed paper in response to a command from the image forming apparatus body 1B.

Figure 2:
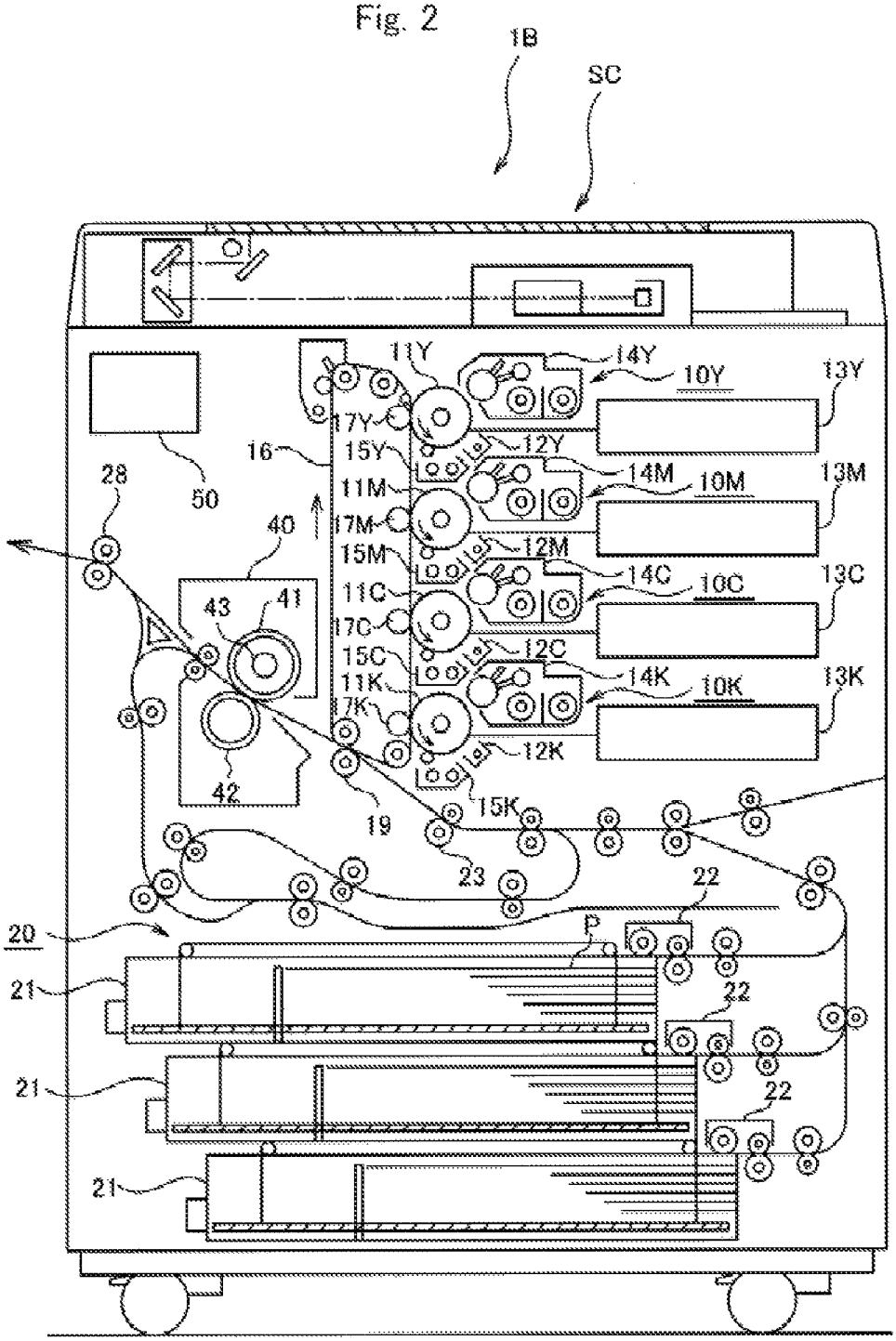
FIG. 2 is a view for schematically showing the configuration of the image forming apparatus body in accordance with the first embodiment.

FIG. 2 is a view for schematically showing the configuration of the image forming apparatus body 1B in accordance with the present embodiment. This image forming apparatus body 1B is, for example, a copying machine which is an electrophotographic image forming apparatus body called a tandem color image forming apparatus. The tandem color image forming apparatus includes a plurality of photoreceptor drums vertically arranged in contact with one intermediate transfer belt to form full-color images.

The image forming apparatus body 1B consists mainly of an original reading unit SC, four image forming units 10Y, 10M, 10C and 10K, a fixing unit 40 and a control unit 50.

The original reading unit SC scans and exposes the image of an original with an optical system of a scanning exposing device, and reads the reflected light therefrom with a line image sensor to obtain image signals. The image signals are processed by performing A/D conversion, shading compensation, data compression and so on, and input to the control unit 50 as image data. Incidentally, the image data input to the control unit 50 is not limited to the image data as captured by the original reading unit SC, but can be the data for example as received from another image forming apparatus body, a personal computer or the like connected to the image forming apparatus body 1B, or stored in a portable recording medium such as a USB memory.

The image forming units 10Y, 10M, 10C and 10K correspond to a device for forming yellow (Y) images, a device for forming magenta (M) images, a device for forming cyan (C) color images, and a device for forming black (K) images respectively.

The image forming unit 10Y is provided with a photoreceptor drum 11Y which is an image bearing member for bearing an image of a predetermined color (yellow (Y)), and a charging unit 12Y, an optical writing unit 13Y, a development apparatus 14Y and a drum cleaner 15Y which are arranged around the photoreceptor drum 11Y.

The photoreceptor drum 11Y is uniformly charged with electricity by the charging unit 12Y, and the optical writing unit 13Y performs a scanning exposure process to form a latent image on the photoreceptor drum 11Y. The development apparatus 14Y then makes visible the latent image on the photoreceptor drum 11Y by developing the image with toner. A toner image (toner image) is thereby formed on the photoreceptor drum 11Y corresponding to yellow. The image formed on the photoreceptor drum 11Y is transferred to a predetermined location of an intermediate transfer belt 16, which is an intermediate transfer member, through a first transfer roller 17Y.

Likewise, the other image forming units 10M, 10C and 10K are provided with photoreceptor drums 11M, 11C and 11K, and charging units 12M, 12C and 12K, optical writing units 13M, 13C and 13K, development apparatuses 14M, 14C and 14K, drum cleaners 15M, 15C and 15K which are arranged around the photoreceptor drums 11M, 11C and 11K respectively. These elements have the similar structure and function as the image forming unit 10Y.

A second transfer roller 19 is provided in contact with the intermediate transfer belt 16 under pressure to form a nip portion therebetween. After transferred to the intermediate transfer belt 16, the images corresponding to the predetermined color components are transferred by the second transfer roller 19 to the banner paper conveyed with a predetermined timing by a paper feed unit 20 to be described below.

The paper feed unit 20 conveys the banner paper along a conveyance route. This conveyance route is provided with a plurality of conveyance units for conveying the banner paper. Each conveyance unit consists of a pair of rollers which are in contact with each other under pressure, and at least one of the rollers is rotationally driven by an electric motor or the like which is a driving mechanism Meanwhile, in place of a pair of rollers, any other appropriate combination such as a combination of belts, a combination of a belt and a roller or the like combination can be used as a pair of rotary members serving as a conveyance unit.

The image forming apparatus body 1B is provided with paper feed trays 21 which may store sheets having predetermined sizes, and therefore capable of forming images also on the sheets supplied from the paper feed trays 21 other than the banner paper. The sheets stored in the paper feed trays 21 are extracted by the paper feed units 22 respectively and transferred to the conveying route.

The fixing unit (fixing device) 40 is an apparatus which fixes an image transferred onto the banner paper. The fixing unit 40 is provided with a pair of fixing members such as a fixing roller 41 and a pressure roller 42 which are arranged in contact with each other and urged against each other to form a fixing nip therebetween, and a fixing heater 43 for heating the fixing roller 41. The fixing unit 40 fixes images onto the banner paper by applying pressure (pressure fixing) with the fixing roller 41 and the pressure roller 42 and applying heat (thermal fixing) with the fixing heater 43.

After the fixing unit 40 processes the banner paper by the fixing treatment, the banner paper is discharged out of the image forming apparatus body 1B by discharging rollers 28, and supplied to the finisher 1C.

The control unit 50 serves to control the image forming apparatus body 1B and can be implemented with a microcomputer which consists mainly of a CPU, a ROM, a RAM, and an I/O interface. The control unit 50 forms images on the banner paper by controlling the image forming apparatus body 1B. Also, the control unit 50 is designed to communicate with the finisher 1C, the paper feed apparatus 1A and the winding apparatus 1D, and capable of forming images in cooperation with these apparatuses.

The finisher 1C is provided with a post-printing unit 60 which performs a post-printing process with the banner paper on which images are formed by the image forming apparatus body 1B, and a control unit 61 for controlling this post-printing unit 60.

For example, the post-printing unit 60 includes a heating unit which adds a gloss to the fixed images by heating it again. The heating unit is provided with thermal heads having a plurality of heat members which are arranged on a straight line in the width direction of the banner paper (the direction transverse to the transfer direction of the banner paper), and located opposite the banner paper being conveyed on the conveying route with a predetermined clearance therebetween.

Incidentally, besides the heating unit, the post-printing unit 60 may also include a printing unit which additionally forms an image on the fixed images or the banner paper. This printing unit is provided with inkjet nozzles which push out ink onto the banner paper to form an image and are arranged opposite the banner paper being conveyed on the conveying route with a predetermined clearance therebetween.

The control unit 61 has a function to control the finisher 1C including the post-printing unit 60. The control unit 61 is implemented with a microcomputer which consists mainly of a CPU, a ROM, a RAM, and an I/O interface.

After performing the predetermined post-printing process, the banner paper is discharged outward from the finisher 1C by the discharging roller 62, and then supplied to the winding apparatus 1D. The winding apparatus 1D winds up the banner paper which is post-printing processed by the finisher 1C and sent out from the finisher 1C.

Figure 3:
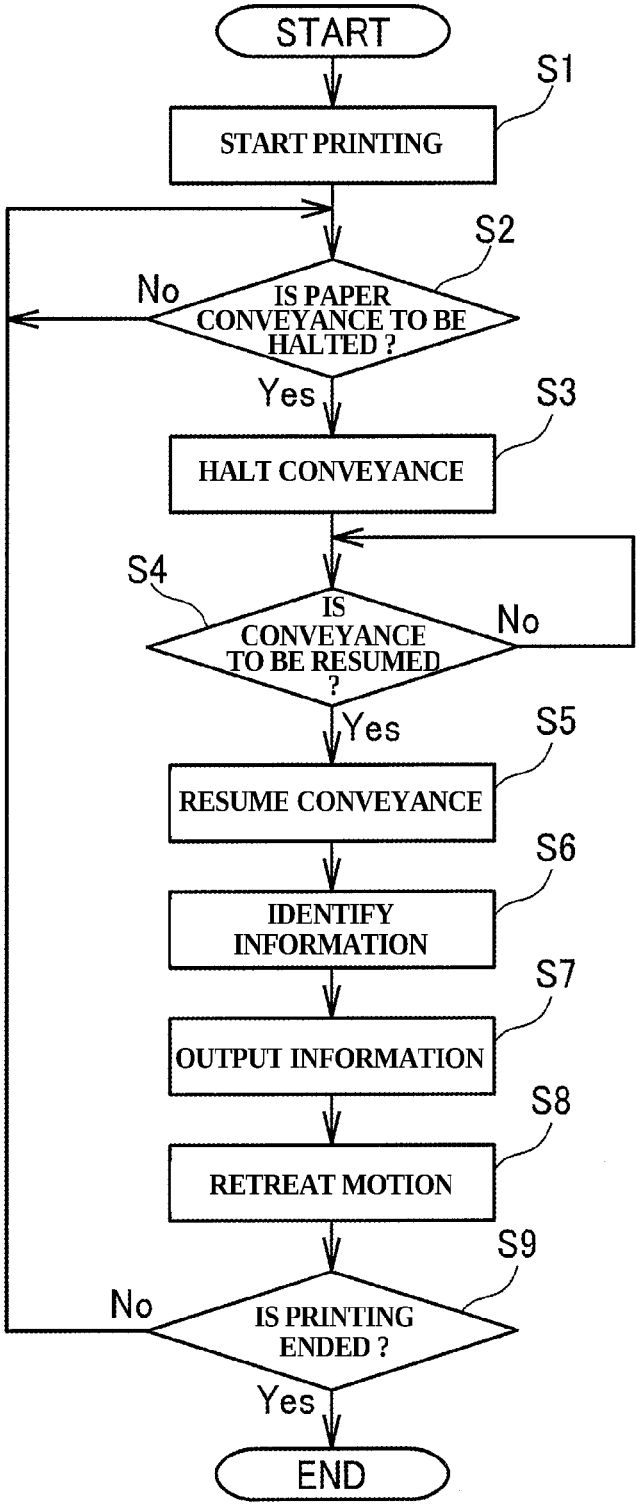
FIG. 3 is a flow chart showing the image forming operation of the image forming system.

In what follows, the image forming operation of the image forming system 1 in accordance with the present embodiment will be explained. FIG. 3 is a flow chart showing the image forming operation of the image forming system 1. The process shown in this flow chart is performed in correspondence with a print job handling a banner paper.

First, in step 1, the control unit 50 of the image forming apparatus body 1B starts printing. While controlling the respective units of the image forming apparatus body 1B, the control unit 50 issues control commands, which are required when starting printing, to the paper feed apparatus 1A, the finisher 1C and the winding apparatus 1D respectively. When starting printing, the paper feed apparatus 1A starts conveying a banner paper, and the image forming apparatus body 1B forms an image on the banner paper which is conveyed. The finisher 1C then performs a predetermined post-printing process of the banner paper which is conveyed. Thereafter, the banner paper discharged from the finisher 1C is wound up by the winding apparatus 1D.

In step 2, the control unit 50 determines whether to halt conveying the banner paper. While the banner paper is continuously conveyed in the usual case, there are some cases where it is needed to halt conveying the banner paper. Such a situation occurs in various cases which includes the following three typical cases.

The first case occurs when image stabilization control is performed. The image stabilization control is the control for adjusting the electrostatic charge amount, the exposure value and the like for the photoreceptor drums 11Y, 11M, 11C and 11K. This control is performed in predetermined cycles. This image stabilization control forms a predetermined patch image on the intermediate transfer belt 16, detects the patch image, and adjusts control parameters with reference to the condition of the detected patch image. When forming the patch image, the transfer nip is released so that the conveyance of the banner paper is temporarily halted.

The second case occurs for the reason to which the finisher 1C is related. The finisher 1C may requires a predetermined time to perform a post-printing process for one cycle. In this case, since synchronization must be established between the post-printing process and the banner paper (image), the conveyance of the banner paper is temporarily halted.

The third case occurs upon malfunction in the conveyance system. There may be defects in the paper feed apparatus 1A, the winding apparatus 1D, the conveyance system provided for the image forming apparatus body 1B, or the conveyance system provided for the finisher 1C. In this case, since the conveyance of the banner paper is in trouble, the conveyance of the banner paper is temporarily halted.

If the determination is in the affirmative in step 2, i.e., if it is determined to halt the conveyance of the banner paper, the process proceeds to step 3. Conversely, if the determination is in the negative, i.e., if it is determined not to halt the conveyance of the banner paper, the process returns to the determination in step 2.

In step 3, the control unit 50 halts the conveyance of the banner paper.

In step 4, the control unit 50 determines whether or not the conditions for resuming the conveyance of the banner paper are met. This determination is made by confirming whether or not the above causing factor of halting the conveyance of the banner paper is resolved. If the determination is in the affirmative in step 4, i.e., if the conditions for resuming the conveyance of the banner paper are met, the process proceeds to step 5. Conversely, if the determination is in the negative in step 4, i.e., if the conditions for resuming the conveyance of the banner paper are not met, the process returns to step 4.

In step 5, the control unit 50 resumes the conveyance of the banner paper.

In step 6, the control unit 50 identifies two information items as explained below. The first information item is the position on the banner paper located in the fixing nip when the banner paper is halted. For example, the paper position is determined as the distance from the leading end of the banner paper as the reference position. The control unit 50 makes use of a paper detecting sensor to detect the leading end of the banner paper in a predetermined position in the upstream side of the fixing nip, for example, for detecting the timing when the banner paper arrives the paper stop roller 23. The control unit 50 can therefore know the positional information of the banner paper which is conveyed based on the conveying speed of the banner paper and the time (elapsed time) after the leading end of the banner paper arrives at the paper stop roller 23. The control unit 50 identifies the position on the banner paper located in the fixing nip when the banner paper is halted.

On the other hand, the second information item indicates the amount of deformation of the banner paper in the paper position which is identified as the first information item when the banner paper is halted. Since the fixing unit 40 has a heat source, when the banner paper is halted while staying in the fixing position (particularly, the fixing nip) for a certain period, the paper may be deformed, for example, in the form of wrinkles attributed to the material of the paper or the material of which toner is made.

FIG. 4 is a table showing examples of the amount of paper deformation occurring in standard sheets. FIG. 5 is a table showing examples of the amount of deformation occurring in polypropylene sheets. The control unit 50 can obtain the amount of paper deformation with reference to the table based on the paper type, the fixing pressure condition, the fixing temperature condition and the halting time. In this case, the paper type is the type of paper of which the banner paper is made; the fixing pressure condition is the condition indicative of the condition of the pressure applied on the pressure roller 42 against the fixing roller 41; and the fixing temperature condition is the condition of temperature during the fixing process. The halting time is the period in which the conveyance of the banner paper is halted.

In step 7, the control unit 50 outputs a data of the information (hereinafter referred to as "halt information") identified in step 6 to the finisher 1C.

In step 8, the control unit 61 of the finisher 1C performs a retreat motion with reference to the halt information output from the image forming apparatus body 1B. This retreat motion is the motion of the post-printing unit 60 to retreat back from the paper in synchronization with the timing when the paper position where the banner paper is deformed arrives at the post-printing unit 60. This retreat motion may be limitedly performed only for the paper position where the amount of paper deformation is larger than a predetermined value. When this paper position is passed through the post-printing unit 60, the retreat motion is finished by restoring the post-printing unit 60 in a normal position in which the post-printing process can be performed.

In step 9, the control unit 50 determines whether to end the print process. If the determination is in the affirmative in step 9, i.e., if the print process ends, the current routine ends. On the other hand, if the determination is in the negative in step 9, i.e., if the print process does not end yet, the process is returned to step 2.

In the case of the image forming system 1 of the present embodiment as has been discussed above, the control unit 50 of the image forming apparatus body 1B determines whether to halt the conveyance of the banner paper, identifies the information about the paper position which coincides with the fixing nip when the conveyance of the banner paper is halted and the information about the amount of paper deformation of the banner paper in the paper position, and outputs the information which is identified.

Namely, when the conveyance of the banner paper is halted, the information about the paper position on the banner paper and the amount of paper deformation is output. It is thereby possible to process the banner paper by appropriately detecting the banner paper which remains in the fixing position when the conveyance of the banner paper is halted by the use of the information which is output.

Also, the control unit 50 of the present embodiment can output the data of the information (halt information) which is identified.

This configuration makes it possible to process banner paper by appropriately acquiring the condition of the banner paper with reference to the output data together with the printed information which is output from the image forming apparatus body 1B.

In the case of the present embodiment provided with the finisher 1C in the downstream side of the image forming apparatus body 1B, the data of halt information is output to the finisher 1C. The control unit 61 of the finisher 1C then controls the post-printing unit 60 based on the halt information output from the control unit 50 of the image forming apparatus body 1B.

In this case, since the data is output to the finisher 1C, it is possible to perform appropriate operations such as the operation of having the post-printing unit 60 retreat from the banner paper in the above paper position corresponding to the fixing position. It is therefore possible to appropriately avoid undesirable situations such that the finisher 1C is damaged by paper which is deformed.

Meanwhile, in the case of the present embodiment, the post-printing unit 60 is controlled to retreat from the banner paper in the paper position corresponding to deformation. However, from the view point of protecting the finisher 1C, the conveyance of the banner paper can be stopped in the case where the paper position corresponding to deformation is passed through the post-printing unit 60, In this case, the control unit 50 may control a display to present a user with the information that the conveyance of the banner paper is stopped.

Furthermore, the control unit 50 of the present embodiment identifies the amount of paper deformation based on the paper type, the fixing pressure condition, the fixing temperature condition and the halting time.

In accordance with this configuration, the amount of paper deformation caused by the fixing operation, which is identified by the control unit 50, depends on the paper type, the fixing pressure condition, the fixing temperature condition and the halting time. The amount of paper deformation can thereby be appropriately identified by taking the above information about fixing operation into consideration as parameters.

Second Embodiment

In what follows, an image forming apparatus according to the second embodiment will be explained. The image forming apparatus 2 of the second embodiment differs from that of the first embodiment as described above in that the finisher is not used in-line but is used off-line. The second embodiment will be explained below mainly with respect to the differences from the first embodiment without repeating redundant description.

Figure 6:
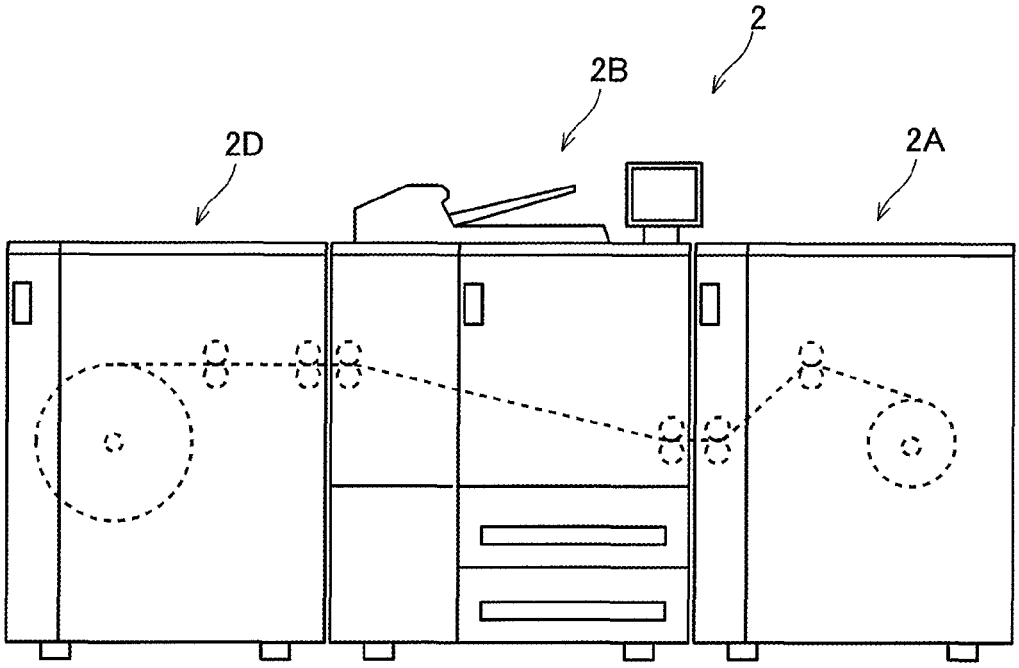
FIG. 6 is an explanatory view for schematically showing the configuration of the image forming apparatus in accordance with a second embodiment.

FIG. 6 is an explanatory view for schematically showing the configuration of the image forming apparatus 2 according to the second embodiment. This image forming apparatus 2 includes an image forming apparatus body 2B accompanied with a paper feed apparatus 2A and a winding apparatus 2D. The paper feed apparatus 2A, the image forming apparatus body 2B and the winding apparatus 2D have the similar configurations as the paper feed apparatus 1A, the image forming apparatus body 1B and the winding apparatus 1D of the first embodiment respectively. Namely, in this image forming apparatus 2, banner paper is supplied from the paper feed apparatus 2A to the image forming apparatus body 2B which forms an image on the banner paper. The banner paper, on which the image is formed, is then successively discharged from the image forming apparatus body 2B and wound up by the winding apparatus 2D.

Figure 7:
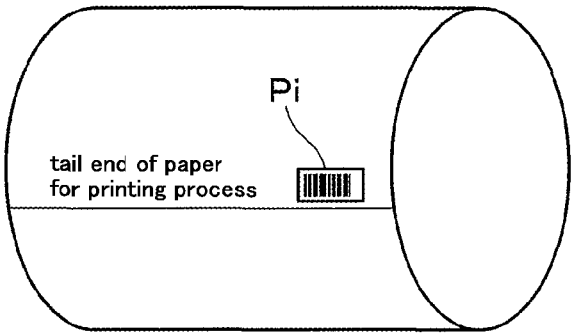
FIG. 7 is an explanatory view for showing a representation which is an image formed on banner paper.

In the case of the present embodiment, the control unit 50 of the image forming apparatus body 2B identifies halt information each time when the conveyance of the banner paper is halted in the same manner as that of the first embodiment. When a print job on the banner paper is completed, the control unit 50 outputs the halt information to the banner paper. More specifically, as illustrated in FIG. 7, the control unit 50 forms the halt information as an image on the tail area of the banner paper (the area in the most downstream end of this continuous paper). The image formed on the banner paper may be an encoded representation Pi (for example, a barcode or a QR code (registered trademark)) from which the halt information can be read out. The banner paper on which the image is formed can be then processed by the finisher 3.

Figure 8:
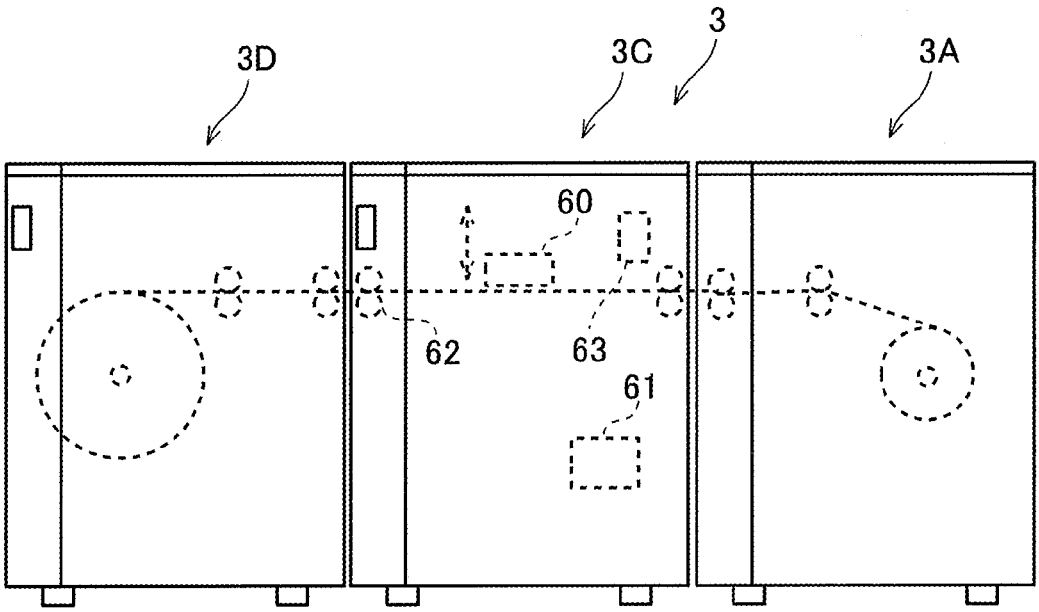
FIG. 8 is an explanatory view for schematically showing the configuration of the finisher in accordance with the second embodiment.
Figure 9:
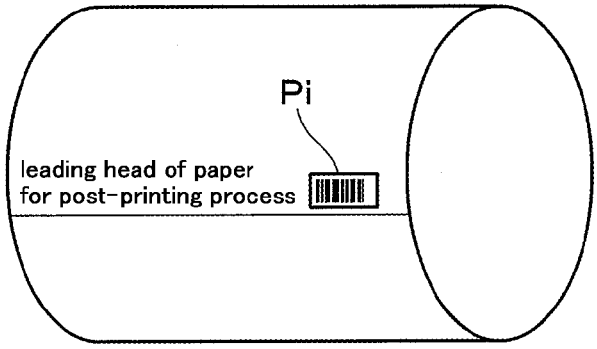
FIG. 9 is an explanatory view for showing a representation which is an image formed on banner paper.

FIG. 8 is an explanatory view for schematically showing the configuration of the finisher 3 according to the second embodiment. The finisher 3 includes a finisher body 3C accompanied with a paper feed apparatus 3A and a winding apparatus 3D. The paper feed apparatus 3A and the winding apparatus 3D have the similar configurations as the paper feed apparatus 1A and the winding apparatus 1D of the first embodiment respectively. After the image formation of the representation Pi, as illustrated in FIG. 9, the banner paper is supplied to the finisher body 3C from the paper feed apparatus 3A, such that the tail end of the banner paper for the previous image formation process becomes the leading head of the banner paper for the next post-printing process.

The finisher body 3C includes a post-printing unit 60 and a control unit 61, and provided further with a reading unit 63.

The reading unit 63 is located in the upstream side of the post-printing unit 60 as seen from the conveyance of the banner paper. This reading unit 63 reads the representation Pi formed on the banner paper, and acquires the halt information from the representation Pi. The acquired halt information is output to the control unit 61.

The control unit 61 performs the retreat motion with reference to the halt information which is read by the reading unit 63. This retreat motion is the motion of the post-printing unit 60 to retreat back from the paper in synchronization with the timing when the paper position where the banner paper is deformed arrives at the post-printing unit 60. This retreat motion may be limitedly performed only for the paper position where the amount of paper deformation is larger than a predetermined value. When this paper position is passed through the post-printing unit 60, the retreat motion is finished by restoring the post-printing unit 60 in a normal position.

In the case of the present embodiment as described above, the control unit 50 of the image forming apparatus body 2B provides the banner paper with the halt information in the form of an image.

With this configuration, even in the case where a post-printing process is performed off-line on banner paper on which image formation has been completed, the halt information can be obtained from this banner paper. The finisher can process banner paper in an appropriate manner by taking into consideration paper conveyance halting periods in which the banner paper is stopped at the fixing position. It is therefore possible to suitably avoid a situation where deformed paper enters the finisher which is then damaged by the deformation.

Also, in the case of the present embodiment, the image formed on the banner paper is a representation of the halt information which is identified.

In accordance with this configuration, the halt information can be automatically obtained from the representation formed on the banner paper by the use of the reading unit 63. The process can be conducted smoothly.

Meanwhile, the image formed on the banner paper may be character information indicative of the information which is identified.

In accordance with this configuration, the halt information can be recognized by a user who makes use of the banner paper. It is therefore possible to operate the finisher body 3C by the user's operation in order to avoid the paper position corresponding to deformation.

Incidentally, even if the finisher body 3C is used off-line, the halt information can be output as data in the same manner as in the first embodiment.

The foregoing description has been presented based on the image forming apparatus and the image forming system according to the embodiments of the present invention. However, it is not intended to limit the present invention to the precise form described, and obviously many modifications and variations are possible within the scope of the invention. Also, the method itself of controlling the image forming apparatus by the control unit can be considered as a part of the present invention. Furthermore, a dedicated control unit can be provided for performing this control method as a separate unit provided independently from the control units for controlling the image forming apparatus and the finisher. For example, the image forming apparatus can be connected through a network to a personal computer in which a server application and a printer driver are installed to monitor the behavior of the image forming apparatus or the like and identify/output the halt information. Still further, while the image forming system consists of the image forming apparatus and the finisher as separate apparatuses, the image forming apparatus can be implemented with a post-printing unit.

What is claimed is:

1. A method of controlling an image forming apparatus which is provided with a pair of fixing members between which is formed a fixing nip where paper is heated and pressed to fix an image thereon, said method comprising:

a first step comprising determining whether to halt conveying banner paper;

a second step comprising identifying information about a paper position on the banner paper that coincides with a position of the fixing nip when the conveyance of the banner paper is halted and identifying and classifying information about an amount of paper deformation of the banner paper in the paper position based on units of length of the paper deformation; and a third step comprising outputting the information identified in the second step.

2. The method according to claim 1, wherein the third step comprises outputting data of the identified information.

3. The method according to claim 1, wherein the third step comprises forming the identified information as an image on the banner paper.

4. The method according to claim 3, wherein the image formed on the banner paper is character information corresponding to the identified information or an encoded representation from which the identified information can be read out.

5. The method according to claim 1, wherein the amount of paper deformation is identified based on a paper type, a fixing temperature condition, a fixing pressure condition and a halting time.

6. The method according to claim 1, wherein the image forming apparatus is provided with a post-printing unit which performs a post-printing process to the banner paper on which an image is fixed, and wherein the method further comprises a fourth step comprising performing a retreat motion of retreating the post-printing unit from a normal position based on the identified information output in the third step.

7. The method according to claim 6, wherein the retreat motion is performed only when the amount of paper deformation is larger than a predetermined value.

8. An image forming apparatus comprising:

a paper conveying unit configured to convey banner paper;

an image forming unit configured to transfer an image to the banner paper;

a fixing unit provided with a pair of fixing members between which a fixing nip is formed, and configured to fix the image to the banner paper with the fixing members by heating and pressing the banner paper conveyed along a conveying route; and a control unit configured to control the paper conveying unit, the image forming unit and the fixing unit, wherein the control unit identifies information about a paper position on the banner paper that coincides with a position of the fixing nip when the conveyance of the banner paper is halted and identifies and classifies information about an amount of paper deformation of the banner paper in the paper position based on units of length of the paper deformation, and output the information which is identified.

9. The image forming apparatus according to claim 8, wherein the control unit configured to output the identified information as data.

10. The image forming apparatus according to claim 8, wherein the control unit configured to form the identified information as an image on the banner paper by controlling the image forming unit.

11. The image forming apparatus according to claim 10, wherein the image formed on the banner paper is character information corresponding to the identified information or an encoded representation from which the identified information can be read out.

12. The image forming apparatus according to claim 8, wherein the amount of paper deformation is identified based on a paper type, a fixing temperature condition, a fixing pressure condition and a halting time.

13. The image forming apparatus according to claim 8, further comprising a post-printing unit which performs a post-printing process to the banner paper on which an image is fixed, and wherein the control unit configured to perform a retreat motion of retreating the post-printing unit from a normal position based on the identified information.

14. The image forming apparatus according to claim 13, wherein the retreat motion is performed only when the amount of paper deformation is larger than a predetermined value.

15. An image forming system comprising:

an image forming apparatus configured to form an image on paper; and a finisher configured to perform a post-printing process to the paper transferred from the image forming apparatus, the image forming apparatus comprising:

a paper conveying unit configured to convey banner paper as the paper to be processed;

an image forming unit configured to transfer an image to the banner paper;

a fixing unit provided with a pair of fixing members between which a fixing nip is formed, and configured to fix the image to the banner paper with the fixing members by heating and pressing the banner paper conveyed along a conveying route; and a first control unit configured to control the paper conveying unit, the image forming unit and the fixing unit, wherein the first control unit identifies information about a paper position on the banner paper that coincides with a position of the fixing nip when the conveyance of the banner paper is halted and identifies and classifies information about an amount of paper deformation of the banner paper in the paper position based on units of length of the paper deformation, and output the information which is identified, the finisher comprising:

a post-printing unit configured to perform a post-printing process to the banner paper as the paper to be processed; and a second control unit configured to control the post-printing unit, wherein the second control unit controls the post-printing unit based on the identified information output from the first control unit of the image forming apparatus.

16. The image forming system according to claim 15, wherein the first control unit configured to output the identified information as data.

17. The image forming system according to claim 15, wherein the first control unit configured to form the identified information as an image on the banner paper by controlling the image forming unit.

18. The image forming system according to claim 17, wherein the image formed on the banner paper is character information corresponding to the identified information or an encoded representation from which the identified information can be read out.

19. The image forming system according to claim 15, wherein the amount of paper deformation is identified based on a paper type, a fixing temperature condition, a fixing pressure condition and a halting time.

20. The image forming system according to claim 15, wherein the second control unit configured to perform a retreat motion of retreating the post-printing unit from a normal position based on the identified information output from the first control unit.

21. The image forming system according to claim 20, wherein the retreat motion is performed only when the amount of paper deformation is larger than a predetermined value.

22. A method of controlling an image forming apparatus which is provided with a pair of fixing members between which is formed a fixing nip where paper is heated and pressed to fix an image thereon, said method comprising:

a first step comprising determining whether to halt conveying banner paper;

a second step comprising identifying information about a paper position on the banner paper that coincides with a position of the fixing nip when the conveyance of the banner paper is halted and information about an amount of paper deformation of the banner paper in the paper position; and a third step comprising outputting the information identified in the second step;

wherein the image forming apparatus is provided with a post-printing unit which performs a post-printing process to the banner paper on which an image is fixed, and wherein the method further comprises a fourth step comprising performing a retreat motion of retreating the post-printing unit from a normal position based on the identified information output in the third step.

23. An image forming apparatus comprising:

a paper conveying unit configured to convey banner paper;

an image forming unit configured to transfer an image to the banner paper;

a fixing unit provided with a pair of fixing members between which a fixing nip is formed, and configured to fix the image to the banner paper with the fixing members by heating and pressing the banner paper conveyed along a conveying route;

a control unit configured to control the paper conveying unit, the image forming unit and the fixing unit; and a post-printing unit which performs a post-printing process to the banner paper on which an image is fixed;

wherein the control unit identifies information about a paper position on the banner paper that coincides with a position of the fixing nip when the conveyance of the banner paper is halted and information about an amount of paper deformation of the banner paper in the paper position, and output the information which is identified; and the control unit configured to perform a retreat motion of retreating the post-printing unit from a normal position based on the identified information.

24. An image forming system comprising:

an image forming apparatus configured to form an image on paper; and a finisher configured to perform a post-printing process to the paper transferred from the image forming apparatus, the image forming apparatus comprising:

a paper conveying unit configured to convey banner paper as the paper to be processed;

an image forming unit configured to transfer an image to the banner paper;

a fixing unit provided with a pair of fixing members between which a fixing nip is formed, and configured to fix the image to the banner paper with the fixing members by heating and pressing the banner paper conveyed along a conveying route; and a first control unit configured to control the paper conveying unit, the image forming unit and the fixing unit, wherein the first control unit identifies information about a paper position on the banner paper that coincides with a position of the fixing nip when the conveyance of the banner paper is halted and information about an amount of paper deformation of the banner paper in the paper position, and output the information which is identified, the finisher comprising:

a post-printing unit configured to perform a post-printing process to the banner paper as the paper to be processed; and a second control unit configured to control the post-printing unit, wherein the second control unit controls the post-printing unit based on the identified information output from the first control unit of the image forming apparatus; and wherein the second control unit is configured to perform a retreat motion of retreating the post-printing unit from a normal position based on the identified information output from the first control unit.

* * * * *